United States Patent [19]

Bonin

[11] Patent Number: 4,770,141

[45] Date of Patent: Sep. 13, 1988

[54] FUEL PUMPING APPARATUS

[75] Inventor: Jean-Claude Bonin, Blois, France

[73] Assignee: Lucas Industries Public Limited Company, Birmingham, England

[21] Appl. No.: 753,418

[22] Filed: Jul. 10, 1985

[30] Foreign Application Priority Data

Jul. 12, 1984 [FR] France ..... 84 11091

[51] Int. Cl.[4] ..... F02D 1/06

[52] U.S. Cl. ..... 123/385; 123/357; 123/387; 123/450; 417/212

[58] Field of Search ..... 123/387, 386, 385, 450, 123/502, 357; 417/212, 462

[56] References Cited

U.S. PATENT DOCUMENTS

| | | | |
|---|---|---|---|
| 2,010,420 | 8/1935 | Simmen | 123/387 |
| 3,547,092 | 12/1970 | Knight | 123/387 |
| 3,614,946 | 10/1971 | Staudt et al. | 123/387 |
| 4,311,296 | 1/1982 | Scheffel | 91/459 |
| 4,417,554 | 11/1983 | Dinger | 123/357 |
| 4,446,835 | 5/1984 | Mowbray | 123/387 |
| 4,450,818 | 5/1984 | Thoma | 123/357 |

FOREIGN PATENT DOCUMENTS

| | | | |
|---|---|---|---|
| 58-93945 | 6/1983 | Japan | 123/387 |

*Primary Examiner*—Andrew M. Dolinar

[57] ABSTRACT

A fuel pumping apparatus for supplying fuel to an internal combustion engine includes a spring loaded fuel quantity control member which is moved by increasing fluid pressure in a chamber to reduce the amount of fuel supplied. The pressure in the chamber is controlled by a pair of ON/OFF valves, the first valve admitting fluid to the chamber and the second valve allowing fluid to escape from the chamber. When the valves are closed an hydraulic lock is created to prevent movement of the member by mechanical forces applied to it during operation of the apparatus.

3 Claims, 5 Drawing Sheets

FUEL PUMPING APPARATUS

This invention relates to a fuel pumping apparatus for supplying fuel to an internal combustion engine and comprising an injection pump operable in timed relationship with an associated engine, a pressure responsive component in the injection pump and electromagnetically operable valve means operable to control the pressure applied to said component, the fluid pressure for application to said component being obtained from a low pressure pump, said pressure responsive component being movable to control an operating parameter of the apparatus.

An example of an apparatus of the aforesaid type is described in British Patent Specification 2037365A. In this example the component is a rotary distributor member the axial position of which determines the quantity of fuel supplied by the apparatus to an associated engine. The component may also be a piston which controls the timing of fuel delivery by the apparatus or a throttle member which determines the fuel flowing through the injection pump and therefore the amount of fuel supplied by the apparatus. In the first two examples the component will in the use of the apparatus be subject to shock loadings due to mechanical forces generated in the apparatus so that the component may be displaced from its intended setting. A simple form of control using for example a restrictor in a passage leading to or from a chamber in which said component is exposed and a valve in a further passage leading from or to the chamber does not afford the desired degree of control since the mechanical forces applied to the member will cause unwanted movement of the member. Even in the example where the component is not subject to mechanical forces, the control obtained is not sufficiently precise.

The object of the present invention is to provide an apparatus of the kind specified in a simple and convenient form.

According to the invention in an apparatus of the kind specified said valve means comprises a pair of valves for controlling flow in a pair of passages respectively one passage being connected to said low pressure pump and the other passage to a drain, said pair of valves being electromagnetically operated and being closed to hydraulically lock said component except when it is required to adjust the position of said component.

Figure 1:
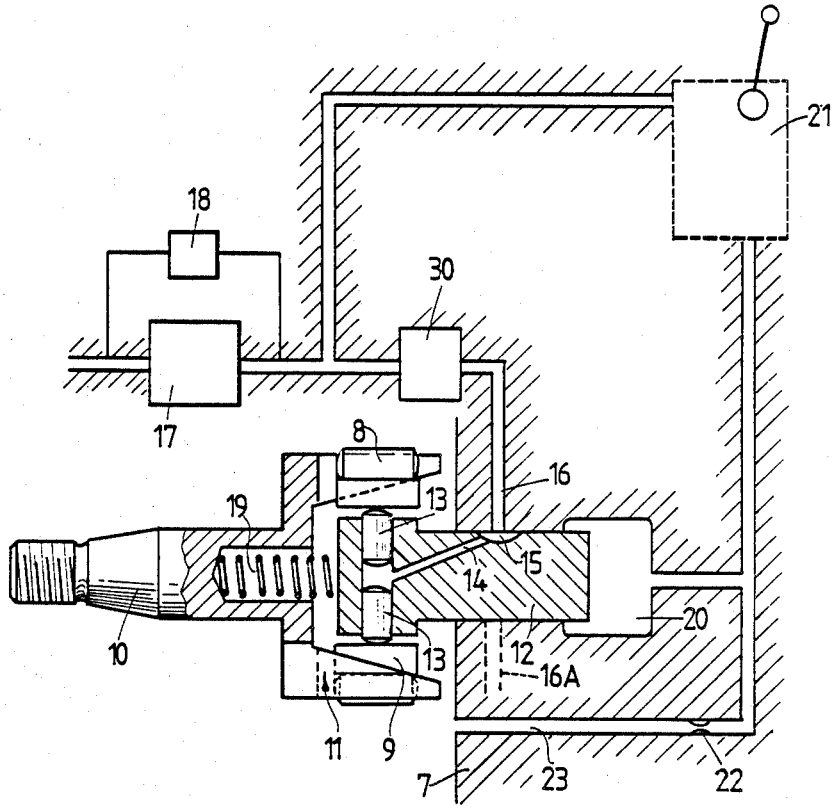
Fig. 1. PRIOR ART
Figure 2:
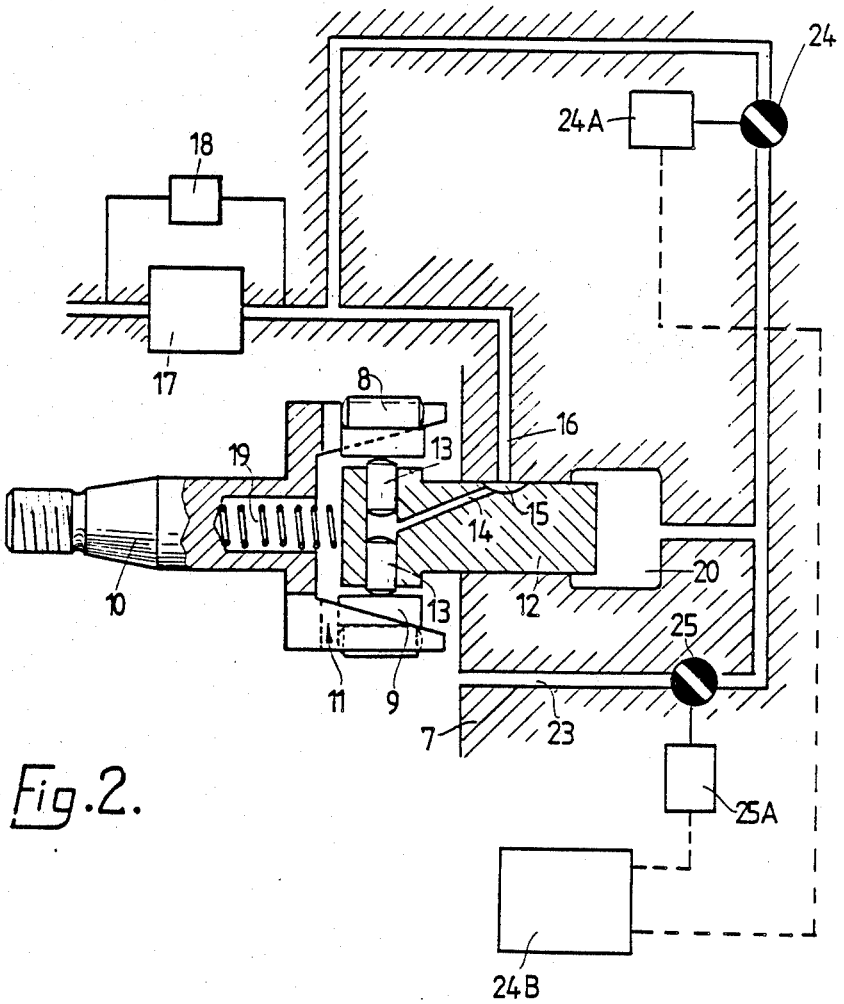
Figure 3:
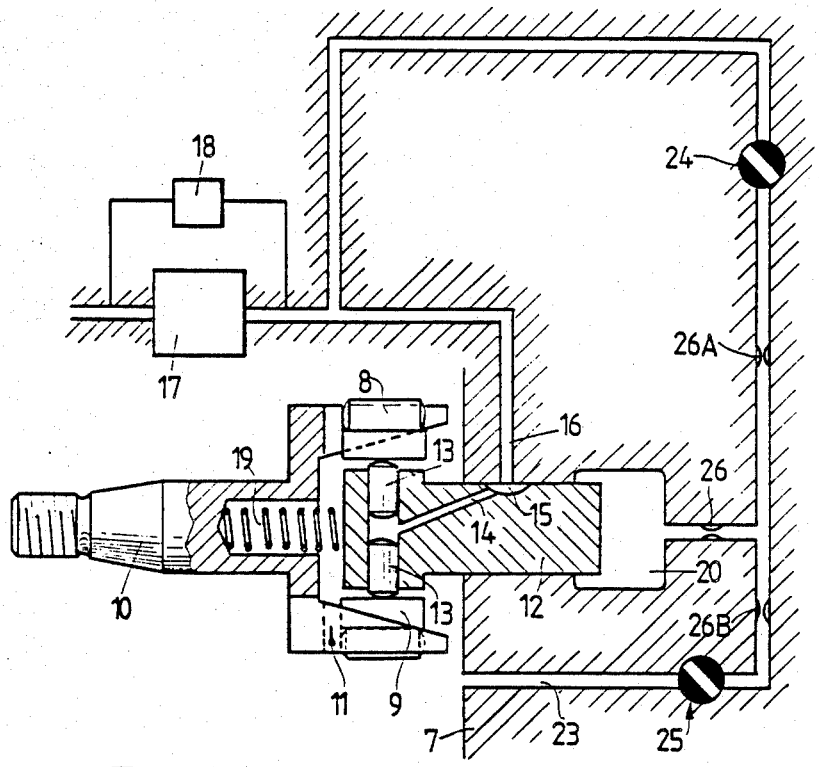
Figure 4:
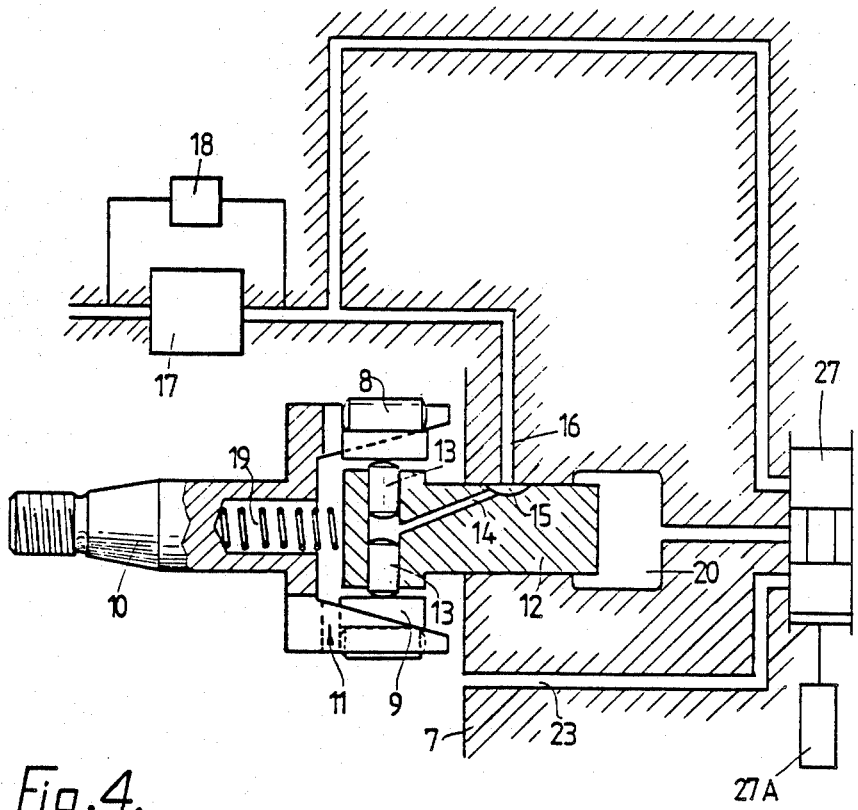
Figure 5:
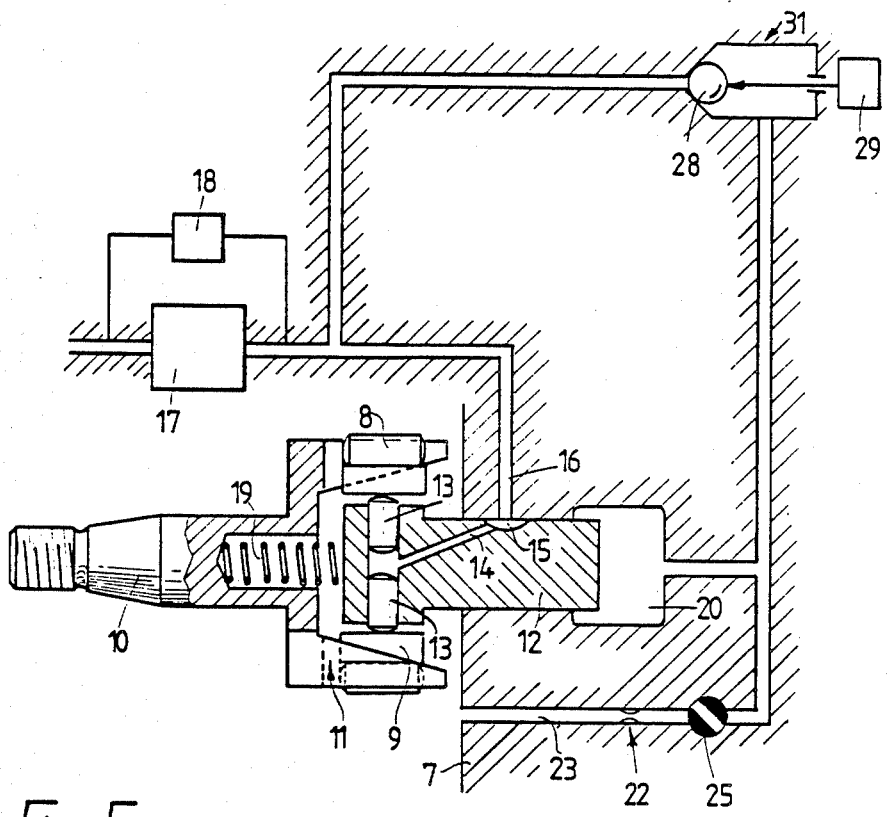

In the accompanying drawings:

FIG. 1 shows in diagrammatic form, one example of an apparatus to which the invention may be applied, FIG. 2 is a diagram similar to FIG. 1 showing one example of an apparatus in accordance with the invention, and FIGS. 3, 4 and 5 represent further examples.

Referring to FIG. 1 of the drawings the apparatus shown therein is described in greater detail in the specification of British Patent 2037365 but for the completeness of the present specification the apparatus comprises a drive shaft 10 which is integrally formed with an annular member 11 of enlarged diameter and within which is located a rotary distributor member 12 which is housed within a body portion 7 of the apparatus. The distributor member is axially movable and is adapted to be driven from the annular member 11 by drive members which engage within radial slots formed in the member 11. The aforesaid slots also accommodate cam followers comprising shoes 9 which at their outer ends carry rollers 8 for engagement with the internal peripheral surface of a surrounding annular cam not shown. The shoes members are axially fixed relative to the distributor member and are slidable in a radial direction in the aforesaid slots formed in the annular member 11. At their inner ends the shoes engage plungers 13 respectively housed within a diametrically disposed bore formed in the distributor member. The internal surface of the annular member 11 is tapered and the shoes 9 are provided with complementary surfaces so that the axial position of the cam followers relative to the annular member, will determine the maximum outward movement of the plungers 13.

The central portion of the bore defined between the plungers communicates by way of a passage 14, with a longitudinally extending groove 15 formed on the periphery of the distributor member and the groove can register in turn with a plurality of inlet ports 16 formed in the body part 7. The inlet ports 16 communicate with the outlet of a low pressure supply pump 17 the pressure of which is conveniently controlled so that it varies in accordance with the speed of operation of the apparatus, by means of a relief valve 18. Alternately arranged with the ports 16 are a plurality of outlet ports 16A only one of which is shown and which are connected in use to the injection nozzles respectively of the associated engine.

The distributor member is biased away from the drive shaft by means of a coiled compression spring 19 which conveniently is located within a recess formed in the drive shaft. As the distributor member is moved by the action of the spring, the plungers 13 can move further outwardly while fuel is being supplied to the bore through a port 16 and the groove 15 thereby increasing the amount of fuel which is supplied to an outlet during the next inward movement of the pumping plungers under the action of the cam lobes.

The movement of the distributor member 12 against the action of the spring is effected by supplying fuel under pressure to a chamber 20 into which the end of the distributor member remote from the drive shaft projects. The end surface of the distributor member is subjected to the pressure of fuel in the chamber 20 and thereby a force is developed which urges the distributor member against the action of the spring 19.

In the apparatus disclosed in the aforementioned British specification fuel under pressure is supplied by way of a restrictor to the chamber 20 and an electromagnetically operated valve is utilized to allow fuel to escape from the chamber, the energization of the valve being under the control of an electronic control system. In the particular example a passage 23 extends from the chamber 20 to a drain and the passage incorporates a restrictor 22. A valve 21 is positioned in a passage extending to the chamber from the outlet of the pump 17 and the valve is electro-magnetically operated with, as in the example described in the aforesaid specification, the control of current to the valve being effected by means of an electronic control system.

The valve 21 can be of the type described in the specification of British Patent 2064720, the current flowing in the solenoid of the valve being determined by the electronic control system in accordance with a number of engine operating parameters and desired operating parameters.

With an apparatus of the aforesaid type should there be any substantial variation in the pressure at the outlet of the low pressure pump or if mechanical force should be applied to the distributor member 12, the axial position of the distributor member will vary in an undesired manner. Mechanical force is applied to the distributor member each time the surfaces on the support members 9 and the member 11 engage with each other. In this example an axial force is produced which will assist the action of the spring. The overall effect is that the position of the distributor member can vary in an undesired manner leading to variations in the amount of fuel delivered by the apparatus.

One solution to the problem is afforded by the modification which is shown in FIG. 2. In this case the valve 21 which of course is of the continuous flow type and the restrictor 22 are replaced by on/off valves 24, 25 respectively. The valve 24 is opened when it is desired to increase the pressure in the chamber 20 and the valve 25 is opened when it is desired to reduce the pressure. When the valves are closed an hydraulic lock is created in the chamber 20 by preventing movement of the distributor member under the action of forces applied to the distributor member and also isolating the chamber except when the valve 24 is opened, from any fluctuations in the output pressure of the low pressure pump 17. The valves 24, 25 are of the on/off type and are controlled by respective solenoids 24A, 25A, the current flow in which is controlled by an electronic control system 24B.

It is convenient to arrange that the control system opens one or the other of the valves at a time when the risk of incorrect positioning due to a pressure fluctuation or the application of mechanical force, is least likely to occur and it is therefore necessary for the control system to only be able to operate the valves at a certain time during the cycle of operation of the apparatus. The control system will therefore be provided with a signal or signals from which can be deduced the correct time for operating the valves.

FIG. 3 shows a further modification in which in the conduit leading to the chamber 20 there is arranged a restricted orifice 26. The effect of this orifice is to restrict the rate of flow of fuel into and out of the chamber 20. This has the effect of damping the movement of the distributor member when either of the valves 24, 25 is opened. It is therefore possible with this arrangement to improve the degree of control over the movement of the distributor member. Instead of the single orifice 26 illustrated in FIG. 3, the orifice can be replaced by separate orifices 26A, 26B in series with the valves respectively.

In FIG. 4, the duty of the valves 24 and 25 is taken over by a spool valve 27 which has a valve member with a central groove in constant communication with the chamber 20 and has lands which in the closed position as shown, cover ports leading to the outlet of the pump 17 and the drain respectively. The spool valve can be controlled by an electromagnetic device 27A which in this case must be able to hold the valve member in the intermediate position or move it to one or other of its extreme positions. A solenoid device or a stepper motor may be employed for this purpose.

In the examples of FIGS. 2, 3 and 4 when the valves 24, 25 are closed, any leakage of fuel into the chamber 20 from the outlets 16A or the groove 15 along the working clearance between the distributor member 12 and the bore in which it is located, will tend to increase the pressure in the chamber 20 and thereby urge the distributor member to reduce the amount of fuel supplied to the associated engine.

With the examples described with reference to FIGS. 1–4, a problem can arise if failure of the electronic control system occurs such as to reduce the pressure in the chamber. The spring 19 will in the absence of fuel under pressure in the chamber 20 move the distributor member towards the maximum fuel position and this can lead to dangerous overspeeding of the associated engine. This problem can be minimised by providing an on/off valve 30 in the connection between the outlet of the low pressure pump 17 and the inlet port 16. If this valve is closed then the supply of fuel to the associated engine will cease irrespective of the position of the distributor member. The apparatus described in the specification of British Patent 2037365 incorporates such a valve.

In normal circumstances however the valve 21 in the example of FIG. 1, when it is required to stop the engine, will move to offer least restriction to the flow of fuel. As a result when stopping the engine the distributor member will move to the minimum fuel position and this may have the effect of stopping the engine even if the aforesaid ON/OFF valve 30 is faulty. The engine operator will not therefore be aware that the ON/OFF valve is faulty. If with a faulty ON/OFF valve 30 and in a failure situation where the valve 21 remains closed, there is a danger of overspeeding of the engine.

In the examples of FIGS. 2–4 the valves 24, 25 are arranged to move to the closed position on engine shut down and hence the distributor member will be locked. Any failure of the ON/OFF valve will be apparent to the engine operator by the fact that the engine has not stopped. The ON/OFF valve is therefore checked each time the engine is stopped and the risk of the ON/OFF valve not operating when for example the valve 25 fails in the open position is minimised.

In the example of FIG. 3 the use of two orifices 26A, 26B as described instead of the single orifice 26 can provide for emergency operation of the engine in the event that one of the valves fails in the open position. The other valve can be operated to effect a measure of control over the pressure in the chamber 20 and hence the amount of fuel supplied by the apparatus to the associated engine.

Turning now to FIG. 5 the valve 25 is retained but downstream of the valve there is located a restricted orifice 22. The valve 24 is however replaced by another form of valve indicated at 31 and which comprises a valve member 28 conveniently in the form of a ball. The ball is urged into contact with the seating by the force developed by an electromagnetic device 29. The device 29 and the solenoid which controls the operation of the valve 25 are under the control of the electronic control system. The operation of the arrangement shown in FIG. 5 therefore is exactly the same in normal circumstances as that which is shown in FIG. 2 with the exception that the rate of escape of fuel from the chamber 20 is controlled by the orifice 22.

In the event of failure of the electronic control system, and a cessation of the supply of current to the device 29, the distributor member will automatically be moved to the minimum fuel position. This may result in stopping of the associated engine due to an insufficient fuel supply irrespective of whether an on/off valve 30 is incorporated in the inlet 16.

With the arrangement shown in FIG. 5, it is possible to arrange for a limited fuel supply to the associated engine for the purpose of operating the engine to allow for example a vehicle driven by the engine to be moved to a safe situation. For this purpose it is arranged that the control system when it has failed, provides a limited current flow in the device 29 so as to apply a small force to effect closure of the valve 28. The valve 25 will be in the open position. When therefore an attempt is made to start the engine the distributor member due to the action of the spring 19 will be at its maximum fuel setting and the engine will therefore start but as soon as the output pressure of the low pressure pump increases beyond a predetermined value as determined by the force exerted on the valve member 28, the latter will be lifted from its seating and fuel under pressure will be supplied to the chamber 20. This will cause movement of the distributor member towards the minimum fuel position but the final position of the distributor member will depend upon the pressure in the chamber 20 and this pressure will depend upon the output pressure of the low pressure supply pump, the effective size of the orifice created by the valve 31 and the size of the orifice 22. These can be contrived so that the engine will operate at a safe speed to permit the vehicle to be moved.

I claim:

1. A fuel pumping apparatus for supplying fuel to an internal combustion engine and comprising an injection pump operable in timed relationship with an associated engine, a pressure responsive component in the injection pump controlling the amount of fuel supplied by the injection pump and electromagnetically operable valve means operable to control the pressure applied to said component, said pressure responsive component being subject to movement while fuel is being supplied to said internal combustion engine by said injection pump via said pressure responsive component thereby making the amount of fuel delivered to said internal combustion engine subject to variation, the fluid pressure for application to said component being obtained from a low pressure pump, said pressure responsive component being movable to control an operating parameter of the apparatus, characterized in that said valve means comprises means for locking said pressure responsive component against movement while fuel is being supplied to said internal combustion engine via said pressure responsive component, said locking means including a hydraulic lock, said hydraulic lock including a pair of valves for controlling flow in a pair of passages respectively, one passage being connected to said low pressure pump and the other passage to a drain, said pair of valves being electromagnetically operated and being closed to hydraulically lock said component while fuel is being supplied to said internal combustion engine via said pressure responsive component, said valves being opened to release said hydraulic lock when it is required to adjust the position of said component, and said valves comprise coupled valve elements, the position of said coupled valve elements being determined by an electromagnetic device, the supply of electric current to the device being effected by an electronic control system, and said control system being arranged to operate said valves in synchronism with the injection pump.

2. An apparatus according to claim 1 characterised by a restrictor in a passage through which said valves communicate with said pressure responsive component.

3. An apparatus according to claim 1 characterised in that the passages of said pair of passages each incorporate a restrictor.

* * * * *